United States Patent [19]

Hendriks

[11] 4,391,893

[45] Jul. 5, 1983

[54] MAGNETIC DEVELOPERS AND PROCESS FOR THEIR PREPARATION

[75] Inventor: Dieter Hendriks, Geneva, Switzerland

[73] Assignee: Sublistatic Holding, S.A., Glaris, Switzerland

[21] Appl. No.: 202,100

[22] Filed: Oct. 30, 1980

Related U.S. Application Data

[63] Continuation of Ser. No. 948,288, Oct. 2, 1978, abandoned, which is a continuation of Ser. No. 737,371, Nov. 1, 1976, abandoned.

[30] Foreign Application Priority Data

Nov. 6, 1975 [CH] Switzerland ..... 14347/75
Jan. 30, 1976 [CH] Switzerland ..... 1200/76

[51] Int. Cl.[3] ..... G03G 9/10

[52] U.S. Cl. ..... 430/137; 430/903; 427/27; 427/221; 428/407

[58] Field of Search ..... 427/27, 220, 221; 428/403, 407; 430/107, 903, 137

[56] References Cited

U.S. PATENT DOCUMENTS

| | | | |
|---|---|---|---|
| 3,326,848 | 6/1967 | Clemens et al. | 260/42.21 |
| 3,377,286 | 4/1968 | Stricklin | 252/62.1 P |
| 3,561,003 | 2/1971 | Lanham et al. | 159/48 R |
| 3,805,869 | 4/1974 | Winter et al. | 159/4 B |
| 3,910,846 | 10/1975 | Azar | 252/62.1 P |

FOREIGN PATENT DOCUMENTS

| | | | |
|---|---|---|---|
| 987767 | 3/1963 | United Kingdom | 430/34 |

*Primary Examiner*—John E. Kittle
*Assistant Examiner*—John L. Goodrow
*Attorney, Agent, or Firm*—Joseph G. Kolodny

[57] ABSTRACT

Developers consisting of virtually spherical particles made by spray drying an aqueous dispersion of a magnetic substance and a coating material consisting of polymers or waxes or of a mixture of polymers with a wax and/or a plasticizer, their constituents being preferably water-dispersible, and process for their preparation.

5 Claims, No Drawings

MAGNETIC DEVELOPERS AND PROCESS FOR THEIR PREPARATION

This is a continuation of application Ser. No. 948,288, filed Oct. 2, 1978 now abandoned, which in turn became a continuation of Ser. No. 737,371, filed Nov. 1, 1976, now abandoned.

Single-component powder developers consisting of particles comprising a finely divided ferromagnetic material coated with an organic substance which is generally a polymer, but which can be a wax, or a wax-polymer or plasticiser-polymer mixture, are known. These developers (toners) can contain various types of pigments, in particular dyestuffs which pass into the vapour state at between 100° and 220° C. under atmospheric pressure.

Various methods have been proposed for preparing these toners. One, in particular, which has the advantage of giving virtually spherical particles, employs drying, in an appropriate stream of air, of a cloud of droplets obtained by spraying a suspension or dispersion of magnetic particles in a solution of the coating substance in an organic solvent. This solvent can optionally contain dyestuffs which require to be incorporated into the toner.

However, the drying in a stream of air (spray drying) of an organic solution which has been reduced to droplets by spraying is not without danger, and the explosion hazards, in particular, impose rather tight limits on this process by imposing a maximum rate of volatile solvent evaporated. Other limitations arise from the fact of the solubility of the coating substances in the solvent and the viscosity of the solutions thus obtained. Finally, if they are prepared by this method, the toner particles tend to form agglomerates, even after drying in vacuo, which causes faults when the particles are employed.

The present invention relates to a new process for preparing single-component powder developers containing a magnetic substance, which process is much less dangerous and more flexible and this makes it possible to obtain developers which have no tendency to form agglomerates, or have such a tendency to a very much lower degree.

The process according to the invention is characterised in that a cloud of droplets obtained by spraying an aqueous suspension or dispersion of the coating material and of the magnetic substance is dried in a stream of air.

Surprisingly, no after-treatment, such as washing for the purpose of removing the dispersing agents, emulsifiers and other adjuvants present in the toner, is necessary, whilst these adjuvants, present in the starting suspension or dispersion, could unfavourably modify the surface tension of the toner particles obtained.

The aqueous dispersions or suspensions treated in accordance with the process of the invention, and hence the toners obtained, which also form part of the invention, contain a coating material consisting of a polymer, a wax, or a wax-polymer or polymer-plasticiser mixture, as well as a magnetic substance. They can also contain a pigment, for example carbon black, or a dyestuff or a mixture of dyestuffs, in particular dyestuffs which pass onto the vapour state at between 100° and 220° C. under atmospheric pressure, as well as electrically conductive materials and adjuvants which, for example, modify the surface properties of the developer particles, such as antistatic agents, hydrophobic agents, agents which improve the flow of the powder or maintain its rheological properties, or adjuvants such as emulsifiers or anti-foaming agents which facilitate the preparation of the developers.

Single-component magnetic developers are thus obtained, which also form the subject of the invention and which consist of virtually spherical particles made by spray drying an aqueous dispersion of a magnetic substance and a coating material consisting of polymers or waxes or a mixture of polymers with a wax or a plasticiser. Generally the constituents of said developers are dispersible in water.

The polymer which can constitute the coating material can be chosen from amongst polymers of very diverse categories. They can be thermoplastic polymers softening between 100° and 160° C., if they are capable of forming a film and are dispersible in water, they are of particular interest. It is also possible to use mixtures of water-dispersible polymers and polymers which are soluble in an organic medium, or mixtures of thermoplastic resins with other types of resin, for example brittle resins such as modified phenol-formaldehyde resins or modified maleic anhydride/polyhydric alcohol resins or esterified diphenol resins, or copolymers. The latter can be block or graft copolymers and can optionally consist of a mixture of crystalline and amorphous segments.

They can be chosen from among the polysaccharide ethers and esters, such as cellulose esters, particularly cellulose acetate or acetobutyrate, and especially such as cellulose ethers, for example benzylcellulose, hydroxyethylcellulose, hydroxybutylcellulose, hydroxypropylcellulose, 2,3-dihydroxypropylcellulose or particularly ethylcellulose. They can also be mixtures of thermoplastic resins with other types of resins, for example brittle resins such as modified phenolformaldehyde resins or modified maleic anhydride- polyhydric alcohol resins, or esterified diphenol resins, or copolymers. The latter can be block copolymers or graft copolymers and can optionally consist of a mixture of crystalline and amorphous segments.

Materials to be mentioned are the polyesters, polyamides, polyolefins, epoxy resins, vinyl resins, acrylic resins, polystyrenes, the copolymers of styrene or styrene homologue with alkylmethacrylates or alkylacrylates, the phenol formaldehyde resins, optionally modified by colophonium, the epoxy resins, the polyethylenes, the polyvinylchlorids, the alkyd resins modified by colophonium and mixtures thereof such as the mixture of polystyrene with polybutadiene, of acrylic polymers with polyvinylacetate, of polyurethanes with vinyl polymers as well as mixtures of polyamides with polyolefines.

Examples which may be mentioned amongs the polyesters are those obtained by reaction of polyglycidyl ethers of a polyhydric phenol with monocarboxylic or dicarboxylic fatty acids, or the polyesters obtained by reaction of dicarboxylic acids with polyols such as, for example, 2-methylpropane-1,3-diol, or with glycols.

Examples which are to be mentioned amongs the polyamides are mixtures containing aromatic polyamides possessing benzoxazole, benzothiazole or benzimidazole nuclei, polyamides prepared from polymerised fatty acids and ethylenediamine, polyalcohols and hydroxyamides.

The following terpolymers can be cited as examples: the vinyl acid/hydroxyalkyl acrylate or methacrylate/vinyl monomer or acrylic acid/vinylidene chloride/acrylonitrile terpolymers, or the copolymers of a vinyl ester, ethylene and an acrylamide. Or the olefine/acrylate copolymers, or the copolymers of alkyl and esters and hydroxylalkyl esters of acrylic acid and of methacrylic acid.

Amongst the plasticisers which can be used in accordance with the present invention, there may in particular be mentioned esters of phosphoric acid such as tributyl phosphate, methyl diphenyl phosphate, cresyl diphenyl phosphate, tri-(2-ethylhexyl) phosphate, triethyl phosphate or triphenyl phosphate, esters of phthalic acid, and various esters such as abietates, adipates, butyrates, hexanoates, glycolates or stearates, for example diisooctyl adipate, methyl abietate, butyl stearate, triethylene glycol di-(2-ethylbutyrate) or triethylene glycol di-(2-ethylhexanoate), there may also be mentioned amides, such as p-toluenesulphonamide, mineral oils, fatty acids, such as linseed oil, fatty alcohols, such as myristyl alcohol or stearyl alcohol, vegetable oils or plasticisers of various kinds such as comphor, benzene hexachloride, $\beta$-(p-ter.-amyl or -butyl)-phenoxyethanol, phenol, phenylcellosolve and the like. The developers can contain between 0.5 and 30% plasticiser, preferably at between 5 and 20%.

The waxes which can be used in accordance with the present invention can be either of mineral origin or of vegetable or animal origin and can be in the crude state or refined, they can also be synthetic. They can be esters of high molecular weight fatty acids and high molecular weight alcohols, or long-chain paraffins and their derivatives (alcohol, halogenated derivatives, ketones, acids, ethers, or esters of cyclic or aliphatic alcohols) obtained by FISCHER-TROPSCH synthesis, derivatives of polyethylenes or of polyolefines which have been polymerised using ZIEGLER-NATTA catalysts. It is also possible to use mixtures, which optionally contain metal salts, silicone oils, polyethylene or polyisobutylene. All these products, though having different chemical structures, have similar rheological properties, namely they are thermoplastic, melt at a rather low temperature, in general at about 80° C. or 65° C., and even 40° C. (myrtle wax) or 11° C. (jojoba wax) but, apart from a few exceptions, always below 90° C., they have a low viscosity in the molten state, are not thread-pulling and virtually contain no compounds which leave an ash. They easily form pastes or gels. They can be malaxated from 20° C. upwards. Furthermore, they are opaque or translucent.

Examples which may be mentioned are beeswax, ozokerite, myrtle wax, Japan wax, China wax, sugar cane wax, palm wax, carnauba wax, candellila wax, caranda wax, hydrogenated castor oil, certain mineral bitumens, such as the esters of the acid $C_{27}H_{55}COOH$ wit.. ceryl or myricyl alcohol (MONTAN WAX), mixtures of cetyl alcohol with octadecyl alcohol or stearyl alcohol (LANETTE WACHS), mixtures containing the palmitate of myricyl alcohol ($C_{15}H_{31}COO$-$C_{30}H_{61}$), cerotic acid ($C_{25}H_{61}$-COOH) or melissic acid ($C_{29}H_{59}COOH$), the myricyl ester of cerotic acid, or ceryl alcohol, or substances of the formula $C_{30}H_{58}O_3$ or $C_{32}H_{66}$, for example.

If, instead of using a dispersion which only contains polymers or a wax, a mixture of a polymer and a plasticiser or a polymer and a wax are used, the polymer can contain up to 85% by weight of wax and up to 30% plasticiser. The coating substances of which the film-forming point is below 100° C. and preferably between 40° and 80° C. are of particular interest.

It is possible to use commercially available aqueous dispersions of polymers or of waxes, as well as the ready-to-disperse corresponding dry products which are also available on the market. These products are well known, in particular as film-forming powder coating agents, as binders for pigment preparations, as additives and binders in the building industries, as adhesives and glues or as textile finishes.

They are principally milky, opalescent liquids containing from 30 to 60% of solids. They are characterised by extreme fineness of the particles (0.03–3$\mu$) and permit the formation of a continuous film by simple evaporation, even at ambient temperature. From the point of view of colloid chemistry, they are comparable with natural rubber latices. The hardness, and consequently the softening point, of the film can be varied within wide limits by mixing appropriate dispersions or by copolymerisation or by internal or superficial addition of plasticiser. Furthermore, these dispersions are distinguished by a high pigment absorption capacity.

Amongst the aqueous dispersions of polymers of this type there may in particular be mentioned dispersions of acrylic ester polymers, such as ACRONAL ® (BASF), of polybutadiene, such as BUTOFAN ® from BASF, of polyvinyl chloride, such as LUTOFAN ® from BASF, of polyvinylidene chloride, such as DIOFAN ® from BASF, of vinyl esters and vinyl ethers, of acrylic resins of various origins, of alkyd resins, of polystyrenes, such as STIROFAN ® of BASF, of polyvinyl acetate and of copolymers and terpolymers corresponding to these products.

The magnetic particles contained in the developer particles of the present invention preferably consist of a ferromagnetic material, for example iron or alloys, and magnetic oxides of, for example, iron, cobalt, nickel and manganese. $Fe_3O_4$ or iron sesquioxide, or barium ferrite or nickel-zinc ferrite, or chromium oxide and nickel oxide, and the like, may be mentioned as example. Their size is of the order of a few microns. Iron oxide $\gamma$-$Fe_2O_3$ can be used in smaller amount than the other magnetic substances mentioned above. Another advantage of this product is that it produces less masking of the colour of the pigments which may be contained in the developer than does $Fe_3O_4$ or iron, which are a strong black colour.

The dyestuffs which pass into the vapour state at between 100° and 220° C. and which can be incorporated into the developers according to the invention can be chosen from the category of the so called basic dyestuffs (cationic dyestuffs) or from the category of the disperse dyestuffs and even from the category of the dyestuffs which are soluble in organic solvents and are classified under the heading "Solvent Dyes" in the COLOUR INDEX edited by THE SOCIETY OF DYERS AND COLOURISTS, Dean House, Picadilly, Bradford, Yorkshire, England, or from the category of the pigments.

They can also be azo dyestuffs, anthraquinone dyestuffs, quinophthalone derivatives, styryl derivatives, diphenylmethanes and triphenylmethanes, oxazine or thiazine derivatives, xanthene derivatives, methines and azomethines, derivatives of acridine and of diazine and the like.

Apart from hydroxyquinophthalone it can be advantageous to use those of the dyestuffs indicated below, in particular from amongst the anthraquinone dyestuffs, which contain at least two substituents which are preferably different from one another.

The following dyestuffs may be mentioned without this list implying a limitation:

1,4-dimethylamino- or 1,4-diisopropylamino-anthraquinone, brominated or chlorinated 1,5-dihydroxy-4,8-diaminoanthraquinone, 1,4-diamino-2,3-dichloroanthraquinone, 1-amino-4-hydroxyanthraquinone, 1-amino-4-hydroxy-2-methoxyanthraquinone, 1-amino-4-hydroxy-2-phenoxyanthraquinone, the methyl, ethyl, butyl or propyl ester of 1,4-diaminoanthraquinone-2-carboxylic acid, 1-amino-4-anilido-anthraquinone, 1-amino-2-cyano-4-anilido- or -cyclohexyl-aminoanthraquinone, 1-hydroxy-2-(p-acetaminophenylazo)-4-methyl-benzene, 3-methyl-4-(nitrophenylazo)-pyrazolone, α-(nitro-phenylazo)-acetoacetylanilide, 3'-hydroxyquinophthalone and, finally, the basic dyestuffs such as malachite green, methyl violet and the following dyestuffs (after modification with, for example, sodium acetate, sodium ethylate, sodium hydroxide or sodium methylate): No. 42,025, 42,037, 42,140, 45,006, 46,025, 48,013, 48,020, 48,035, 50,045, 51,005 and 52,010 of the Colour Index edited by "THE SOCIETY OF DYERS AND COLOURISTS" and "THE AMERICAN ASSOCIATION OF TEXTILE CHEMISTS AND COLORISTS" (2nd. edition, 1956).

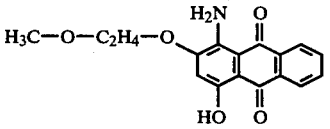

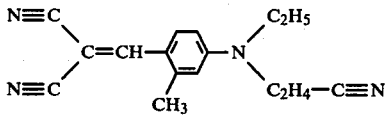

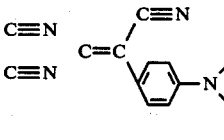

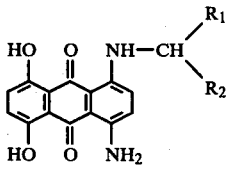

Where $R_1$ and $R_2$ independently of one another represent an alkyl group with 1 to 3 carbon atoms.

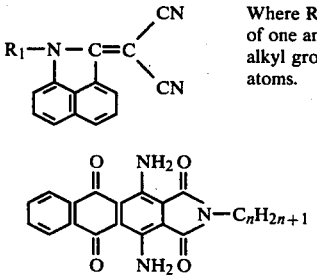

with n < 6

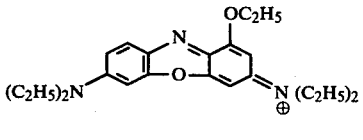

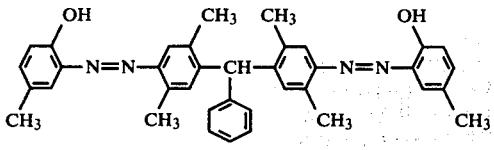

-continued

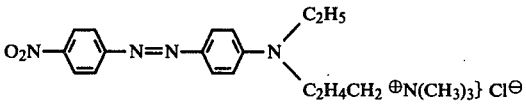

Before drying, the magnetic particles must be mixed with the coating material. This operation is advantageously carried out as follows: the magnetic particles are first malaxated with a dispersing agent (for example CALGON ®, POLYSEL ® or OROTAN ®850) and water, so as to from a viscous paste. The latter is then added, whilst stirring, to an aqueous dispersion of the coating material (polymer optionally mixed with wax or with a plasticiser, or wax), but a different procedure can also be used, the presence of an anti-foaming agent may be necessary.

In addition to the adjuvants already mentioned, such as cross-linking agents, dispersing agents, electrically conductive agents and anti-foaming agents, the properties of the dispersions and consequently the properties of the developer particles finally obtained can be modified at will by the addition of other agents and fillers, such as non-stick agents or antistatic agents, hydrophobic agents, thickeners or agents which improve the flow of the powder. These adjuvants are generally commercially available in the form of aqueous dispersions.

The final suspension intended to be sprayed in the form of droplets and then dried in an appropriate stream of air generally contains from 30 to 60% of solid product and has a viscosity of 10 to 22 seconds in a Ford cup No. 4. The amount of coating material relative to the amount of pigment generally varies between a ratio of 90:10 and 10:90, preferably between 60:40 and 40:60.

The temperature at which the drying is carried out is normally between 150° and 200° C. at the inlet of the apparatus and between 60° and 100° C. at the outlet.

This temperature is determined by the softening point of the coating material and by the minimum temperature at which a film begins to form from an aqueous dispersion of the coating material.

The dyestuff can be added before or after the coating material and the magnetic substance have been mixed.

It is advantageous to incorporate more than 2%, and in particular between 2.5 and 25%, of dyestuff into the developers of the present invention which however in general contain less than 10%, preferably even less than 5%, of dyestuff, and up to 50%, preferably between 10 and 30%, of resin. However, if a magnetic developer of black colour is used, it is possible to employ a magnetic substance coloured black so that it becomes superfluous to add a pigment.

The spraying and the drying can be carried out in a known manner in commercially available apparatuses.

The product obtained can subsequently be subjected to a particle screening operation, for example by centrifuging. In this way, for example, the particles of diameter between 10 and 35μ are isolated.

The powder can also be subjected to a treatment with silicon oxide.

The pulverulent resin compositions of the invention are preferably used in electrophotography, as developers, in particular as powder developers, which can be fixed by pressure, but they can also be incorporated into coating compositions, paints, inks and the like.

The non-limiting examples which follow illustrate the present invention. In these examples, the parts and percentages are to be understood as being by weight, unless stated otherwise, and the temperatures as being in degrees Centigrade.

EXAMPLE 1

50 parts of a water-dispersible preparation containing 20 parts of 1-amino-2-phenoxy-4-hydroxy-anthraquinone, followed by 250 parts of iron oxide $Fe_3O_4$, are dispersed in 150 parts of water.

Thereafter this paste is mixed with 28 parts of a 50% strength dispersion of $SiO_2$. The paste thus obtained is incorporated, whilst stirring, into 340 parts of a dispersion, of about 56% strength, of polyvinylidene chloride and the mixture is diluted with 186 parts of water. The viscosity of the dispersion is 12 seconds, measured in a FORD cup No. 4.

This dispersion is introduced into a "spray dryer", that is to say into an apparatus which permits spraying the dispersion in the form of fine droplets and drying the latter in a stream of air. The temperature at the apparatus inlet is 150° C. (∓3° C.), whilst at the outlet it is 80° C. (∓3° C.). The yield is 2.5 kg of powder per hour.

A black powder which flows freely and of which the particle size is between 3 and 45μ is thus obtained. The particles are screened by centrifuging, only retaining those of diameter varying between 10 and 35μ.

EXAMPLE 2

30 parts of ferrite are dispersed in 15 parts of water with the aid of 0.6 part of dispersing agent, 0.25 part of ammonia and 0.15 part of anti-foaming agent. A homogeneous paste is obtained.

10 parts of a 25% strength aqueous dispersion of carbon black and 5 parts of a 50% strength aqueous dispersion of the yellow dyestuff of the formula

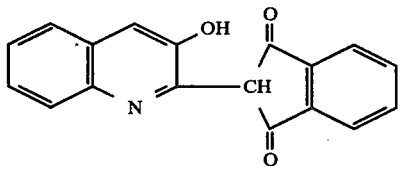

are then added, whilst stirring. Thereafter, 22.5 parts of a 50% strength aqueous dispersion of polystyrene and 9.4 parts of a 40% strength aqueous dispersion of a natural wax (montan wax) having a softening point of 80° C. are added. The mixture is diluted with 7.35 parts of water.

The dispersion thus obtained is then pumped into a turbine-type spray drying apparatus (spray dryer). It is introduced into the spray dryer at 250° C. whilst the temperature at the outlet of the spray dryer is 80° C.

A black powder which flows freely and of which the particle size is between 5 and 40μ is thus obtained. 0.2% of $SiO_2$ is added and the particles are screened, only retaining those of diameter varying between 10 and 35μ.

This powder makes it possible to obtain very good results in the development of latent electrostatic images and in particular permits better fixing of the developed image than in the case of the known toners, the final copies obtained by subliming the dyestuff on to a receptor carrier are yellow copies of good quality.

EXAMPLE 3

30 parts of a 7% strength solution of ethylcellulose in ethanol, which also contains 2% of dibutyl phthalate, are poured slowly, whilst stirring, into 20 parts of a 50% strength aqueous dispersion of polystyrene.

20 parts of ferrite and 5 parts of a 25% strength dispersion of carbon black are then dispersed in the above preparation. The mixture is diluted with 25 parts of water. This dispersion is then pumped into a turbine-type spraying and drying apparatus (spray dryer). It is introduced at 120° C. and the dried product issues from the spray dryer at about 86° C.

A black powder is thus obtained, which flows freely and in which the size of the particles is between 5 and 40μ. 0.2% of $SiO_2$ is added and the particles are screened, only retaining those of diameter varying between 10 and 35μ.

The developer thus obtained permits development using a magnetic brush, and formation of sharp copies on zinc oxide paper, this developer is easily fixed by pressure.

EXAMPLE 4

It is possible to follow the same procedure as in Example 2, but using 32.5 parts of ferrite in place of 30 parts, 10 parts of a 50% strength aqueous dispersion of the blue dyestuff of the formula

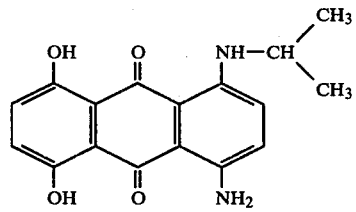

in place of the dispersion of the yellow dyestuff, and 24.25 parts of a 40% strength aqueous dispersion of a natural wax, of softening point 75° C., in place of the aqueous polystyrene dispersion.

A black powder is obtained, which gives results which are as satisfactory as those obtained in Example 2. The final copies obtained by subliming the dyestuff from the image developed with this powder are no longer yellow, but blue.

I claim:

1. Process for the preparation of a developer in the form of virtually spherical particles, wherein a dispersion in water containing (A) 3-hydroxyquinophthalone or (B) an anthraquinone dyestuff which contains at least (1) two amino substituents different from one another or (2) one amino and one hydroxy substituent and which passes into the vapor state at between 150° and 220° C. under atmospheric conditions, of magnetic particles and of a coating material consisting of an aqueous dispersion of a thermoplastic resin or of a mixture of a thermoplastic resin with a wax or a plasticiser, is sprayed in the form of fine droplets and then dried in an appropriate stream of air in a spray dryer apparatus.

2. Process according to claim 1, wherein the dispersion in water contains a dispersion dyestuff.

3. Process according to claim 1, wherein the temperature varies between 150° and 200° C. at the inlet of the spray dryer apparatus used and between 60° and 90° C. at the outlet.

4. Process according to claim 1, wherein the temperature varies between 150° and 200° C. at the inlet of the spray dryer apparatus used and between 120° and 130° C. at the outlet.

5. Process according to claim 1, wherein a dispersion of polystyrene in water, containing $Fe_3O_4$ particles, at least one dispersion dyestuff which passes into the vapour state at between 100° and 220° C. under atmospheric pressure, and a montan wax, is spray-dried.

* * * * *